US005608224A

United States Patent [19]

Alvord

[11] Patent Number: 5,608,224

[45] Date of Patent: Mar. 4, 1997

[54] TARGET CHANGER FOR AN ACCELERATOR

[76] Inventor: C. William Alvord, 505 W. Meadecrest, Knoxville, Tenn. 37932

[21] Appl. No.: 515,032

[22] Filed: Aug. 15, 1995

[51] Int. Cl.[6] ..... G21K 5/10

[52] U.S. Cl. ..... 250/442.11; 250/492.3

[58] Field of Search ..... 250/440.11, 442.11, 250/443.1, 492.1, 492.3

[56] References Cited

U.S. PATENT DOCUMENTS

| | | | |
|---|---|---|---|
| 4,112,307 | 9/1978 | Foll et al. | 250/492.3 |
| 4,323,780 | 4/1982 | Tombaugh et al. | 250/419 |
| 4,341,731 | 7/1982 | Mills, Jr. | 376/156 |
| 4,734,586 | 3/1988 | Crist et al. | 250/492.3 |
| 4,793,908 | 12/1988 | Scott et al. | 204/192.26 |
| 4,952,814 | 8/1990 | Huntzinger | 250/492.3 |
| 5,392,319 | 2/1995 | Eggers | 376/194 |
| 5,416,440 | 5/1995 | Lyons et al. | 250/492.3 |

*Primary Examiner*—Bruce C. Anderson
*Attorney, Agent, or Firm*—Pitts & Brittian, P.C.

[57] ABSTRACT

A target changer for use with an accelerator for changing targets remotely. The target changer includes a beam tube, an end of which is secured to a ring collimator assembly, a carousel barrel which defines a plurality of ports for receiving targets, a carousel hub for permitting the rotation of the carousel barrel and alignment with the ring collimator assembly and beamline, and a motor for controlling the rotation of the carousel barrel.

11 Claims, 6 Drawing Sheets

TARGET CHANGER FOR AN ACCELERATOR

TECHNICAL FIELD

This invention relates to the field of target changers for use in accelerators.

BACKGROUND ART

Accelerators are widely used to produce radionuclides for a variety of uses including positron emission tomography (PET). Generally, an accelerator produces radionuclides by accelerating a particle beam and bombarding a target material with the accelerated beam thereby producing radionuclides. The type of radionuclides produced are determined by the target material and the particle beam. Typically, a selected target material produces an abundance of one particular radionuclide under selected conditions such that a variety of targets are needed to produce different radionuclides in considerable amounts.

Target changers have been incorporated into accelerators for providing access to multiple targets and for changing targets without having to break down the accelerator system to do so. A target changer must be configured to provide particular services to each target. Specifically, each target and target window must be cooled and the target must be monitored. Most commercial accelerator targets or multiple target systems have separate paths to each target for cooling water, helium window cooling, and target current monitoring. In addition, the connection to the main vacuum enclosure of the accelerator is made when the target is installed, usually by means of a gate valve. This requires six connections to be made or broken if a target is to be removed or added. The connection to the vacuum is particularly critical, and failure to perform this step correctly can result in the loss of vacuum, the recovery of which is very time consuming. Further, the time required for installation and removal of a target is an important consideration because installation or removal is usually done in a high radiation field.

Therefore, it is an object of the present invention to provide a target changer for an accelerator which minimizes the number of connections necessary for installing the targets.

It is another object of the present invention to provide a target changer for an accelerator which is configured to minimize the time necessary to install or remove a target.

Further, it is an object of the present invention to provide a target changer for an accelerator in which there is no impact on vacuum integrity when changing targets It is yet another object of the present invention to provide a target changer wherein its alignment with respect to the accelerator can not be misadjusted in the field.

It is another object of the present invention to provide a target changer which is designed such that upon removal of the target changer adjustment is not lost.

Moreover, it is an object of the present invention to provide a target changer with which the alignment procedure can be done remotely and dynamically.

DISCLOSURE OF THE INVENTION

Other objects and advantages will be accomplished by the present invention of a target changer for use with an accelerator for remotely changing targets on accelerator beamlines. The target changer of the present invention includes a beam tube, an end of which is secured to a ring collimator assembly, a carousel barrel which defines a plurality of ports for receiving targets, a carousel hub for permitting the rotation of the carousel barrel and alignment with the ring collimator assembly and beamline, and a motor for controlling the rotation of the carousel barrel.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A target changer for use in an accelerator incorporating various features of the present invention is illustrated generally at 10 in the figures. The target changer 10 is designed for the automated and remote changing of targets on accelerator beamlines. The target changer 10 minimizes the number of connections required to service the target. Further, the target changer 10 is designed to minimize the time required to install or remove a target.

Figure 1:
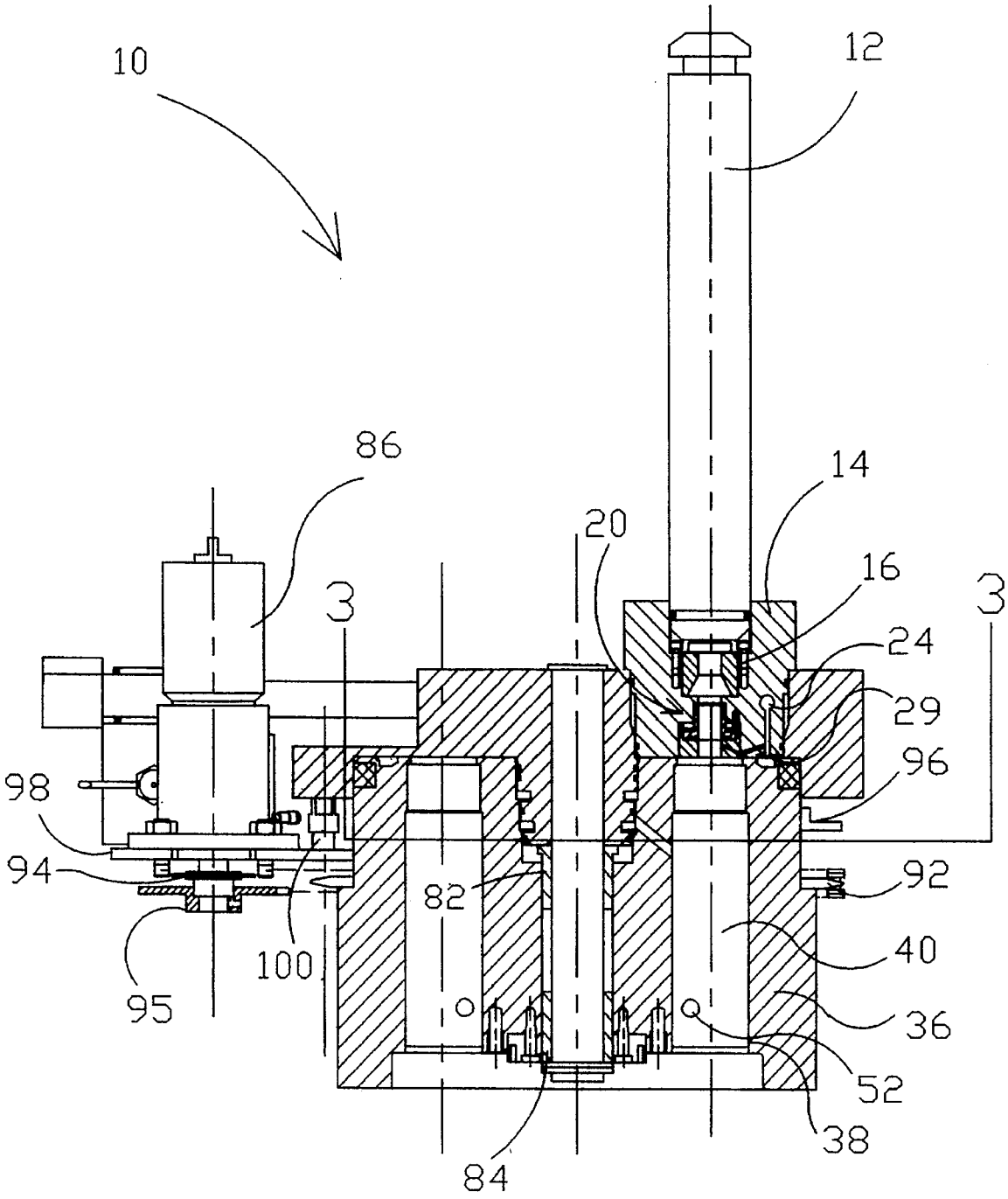
FIG. 1 illustrates a side view, partially in section, of the target changer of the present invention.

The target changer 10 generally includes a ring collimator assembly 14 which includes means for shaping the beam and defines a vacuum window assembly 20, a carousel barrel 36 which provides eight ports 38 for accelerator targets, a carousel hub 46 which distributes water and helium cooling to the targets 40, and a chain drive mechanism 88 which provides the remote positioning of the carousel barrel 36, as shown in FIG. 1. Further, a modular target design allows any target 40 to be installed in any port 38, and an umbilical system provides for the quick installation and removal of any target 40.

Figure 2:
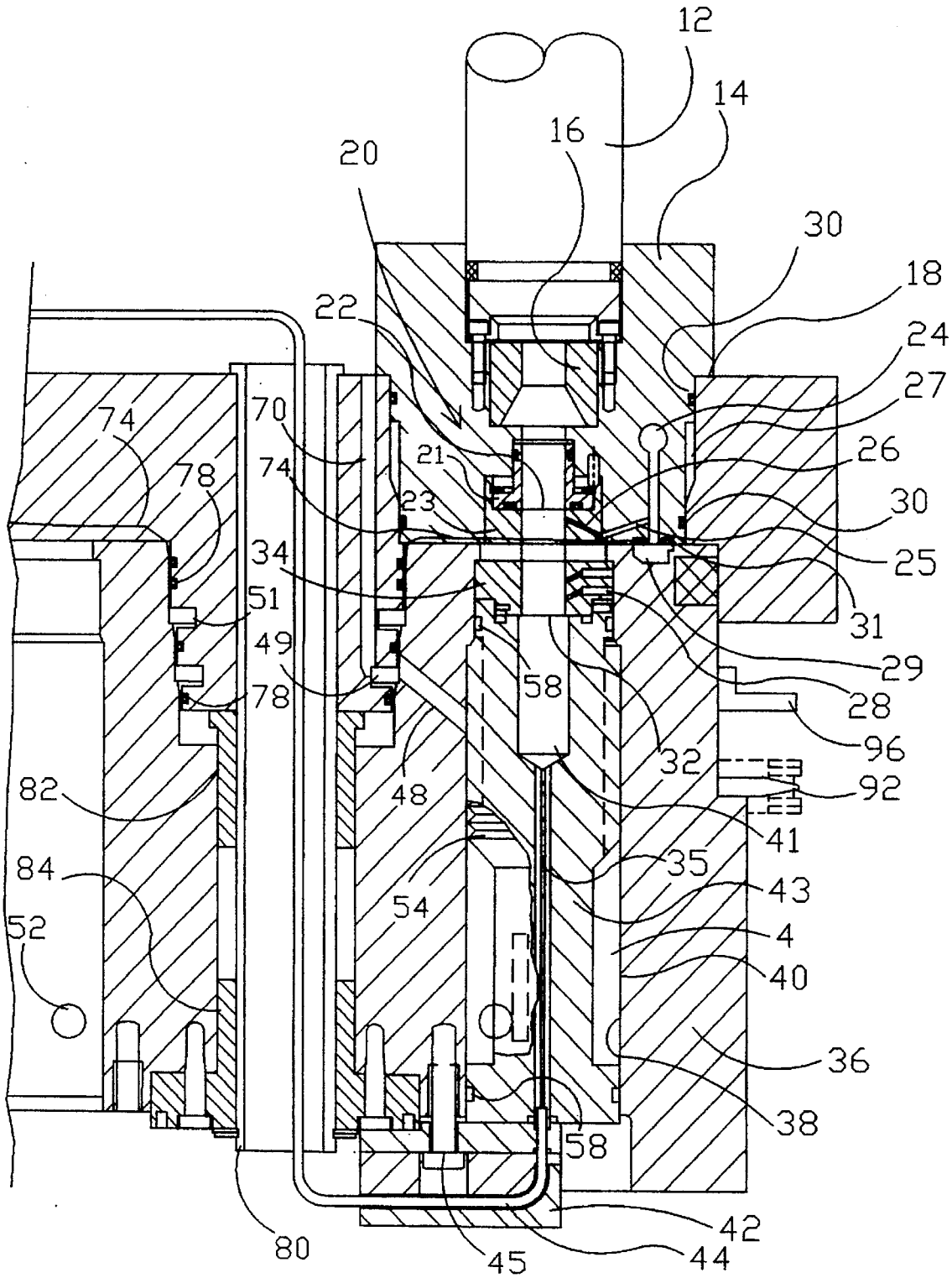
FIG. 2 is an enlarged view, in partial section, of the ring collimator assembly, a portion of the carousel barrel, and the target.

Referring to FIG. 2, a bombarding beam tube 12 is mounted to the ring collimator assembly 14. The first end of the beam tube 12 is mated to the accelerator vacuum tank (not shown). The ring collimator assembly 14 defines a means for shaping the beam and a vacuum window assembly 20. Preferably, the means for shaping the beam is a ring collimator 16. In the preferred embodiment, the ring collimator 16 is a carbon puck that is ring shaped into a very specific 7 mm diameter. The ring collimator 16 intercepts the beam edge such that only the core of the beam is utilized to eventually bombard the target. The collimator 16 is grounded such that the charge that is deposited by the protons hitting the ring collimator 16 is conducted back to the beam tube 12 and vacuum tank. The ring collimator assembly 14 is isolated from the target 40 via an insulating washer 18. The insulating washer 18 serves as a charge isolator to electrically isolate the ring collimator 16 from the target 40. In the preferred embodiment, the insulating washer 18 is a kapton film.

The vacuum window assembly 20 includes a vacuum window 22, a vacuum window support 21 and a vacuum window spacer flange 23. The vacuum window support 21 retains and supports the vacuum window 22. The vacuum window spacer flange 23 receives the vacuum window 22 and its support 21 and provides space between the vacuum window 22 and lower end of the ring collimator assembly 14. The vacuum window spacer flange 23 defines a helium jet 26 which is directed toward the vacuum window 22 and cools the vacuum window 22 with helium. The helium jet 26 is in communication with a helium channel 25 which is in turn in communication with a helium supplier 24. Helium is supplied to the helium supplier 24 via an annular space 27 defined between the ring collimator assembly 14 and the carousel hub 46. Two o-rings 30 are situated, one above and one below the annular space 27, to prevent leakage.

The target changer 10 defines only one vacuum window assembly 20 for use with all targets 40. Prior art systems define a vacuum window assembly for each target. The disadvantage of having a vacuum window assembly for each target is that gate valves or other expensive devices are required to maintain a vacuum. The configuration of the present device eliminates such considerations.

The carousel barrel 36 defines a plurality of ports 38 and a means for circulating cooling fluid for the target 40 and the target window 32. Each of the ports 38 is configured to receive a target 40 which is held in place by an umbilical 42. In the preferred embodiment, the carousel barrel 36 defines eight ports 38. The ring collimator assembly 14 interfaces with one port and the carousel hub 46 interfaces with the remaining ports.

Each target 40 defines a target window 32, a target window spacer flange 34, a target body 43 and a product tube 35, as shown in FIG. 2. The target window spacer flange 34 provides spacing between the target window 32 and the upper end of the target 40. Further, the target window spacer flange 34 defines at least one helium jet 28 for blowing recirculated helium gas on the target window 32. In the embodiment depicted, two helium jets 28 are defined by the target window spacer flange 34 and the helium jets 28 are in communication with the helium inlet 29 defined by the respective port 38. The product tube 35 extends through the length of the target 40 to the rear end thereof. The target body 43 holds a selected target material 41 which can be a gas, liquid, solid or mixture thereof. O-rings 58 are utilized to create a seal between the port 38 and the target 40. The target 40 is retained within the port 38 via the umbilical 42.

The umbilical 42 serves three main purposes: (1) to provide a means for directing the product within the product tube(s) 35 away from the system 10, (2) to make the necessary high pressure connections throughout the target 40, and (3) to retain the target body 43 and spacer flange 34 in the port 38. The umbilical 42 defines at least one product line 44 which mates with product tube 35, when the umbilical 42 is installed, and delivers the product to a delivery point at a location exterior to the target changer system 10. The product line 44 is flexible, and preferably, it is fabricated from 1/16" OD Polyether ether ketone (PEEK) or stainless steel tubing. The umbilical 42 includes a captured socket head screw 45 that screws into the carousel barrel 36. Upon securely screwing the screw 45 into the barrel 36, a high pressure seal is established between the target window spacer flange 34 and the target window 32 and between the target window 32 and the target body 43.

Figure 3:
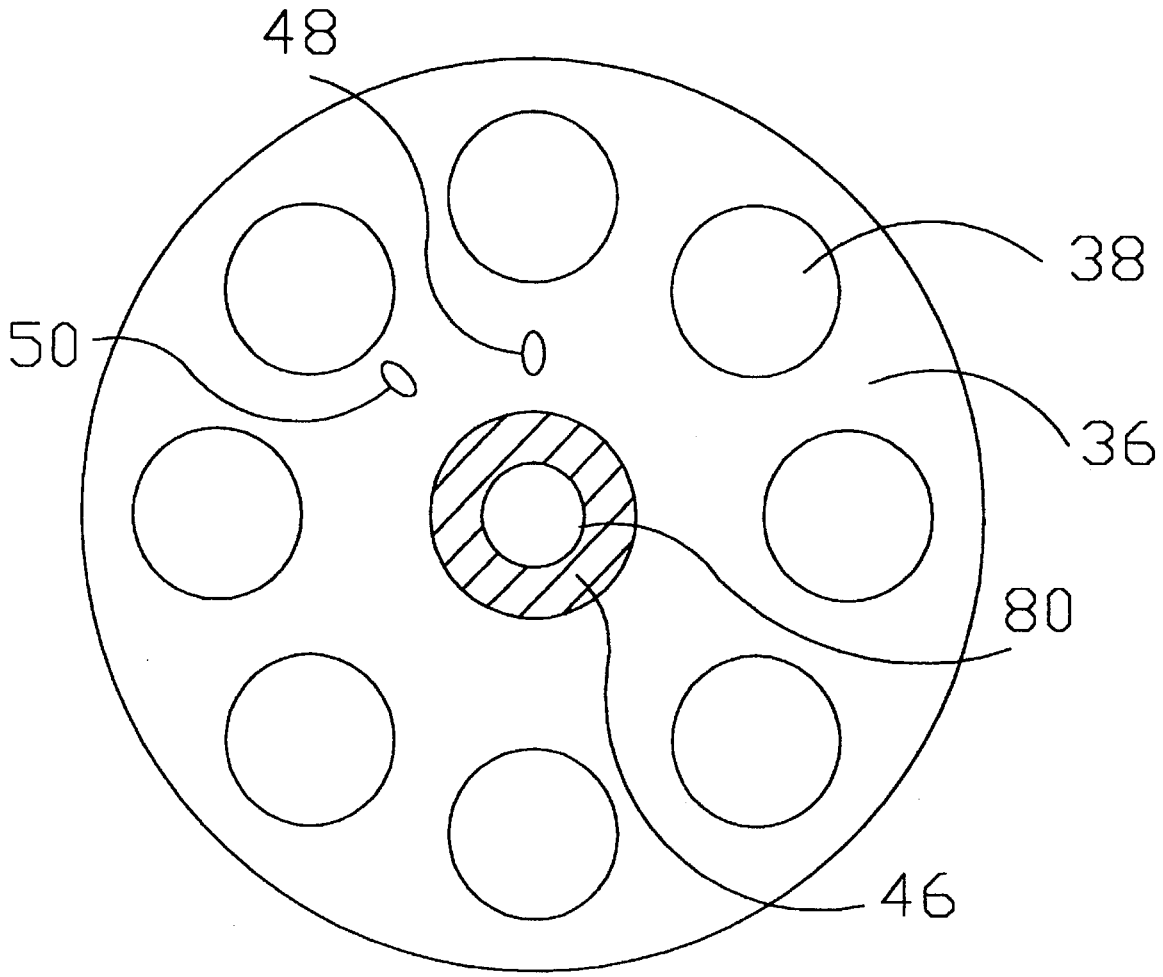
FIG. 3 is a cross sectional view of the carousel barrel along line 3—3 of FIG. 1.
Figure 4:
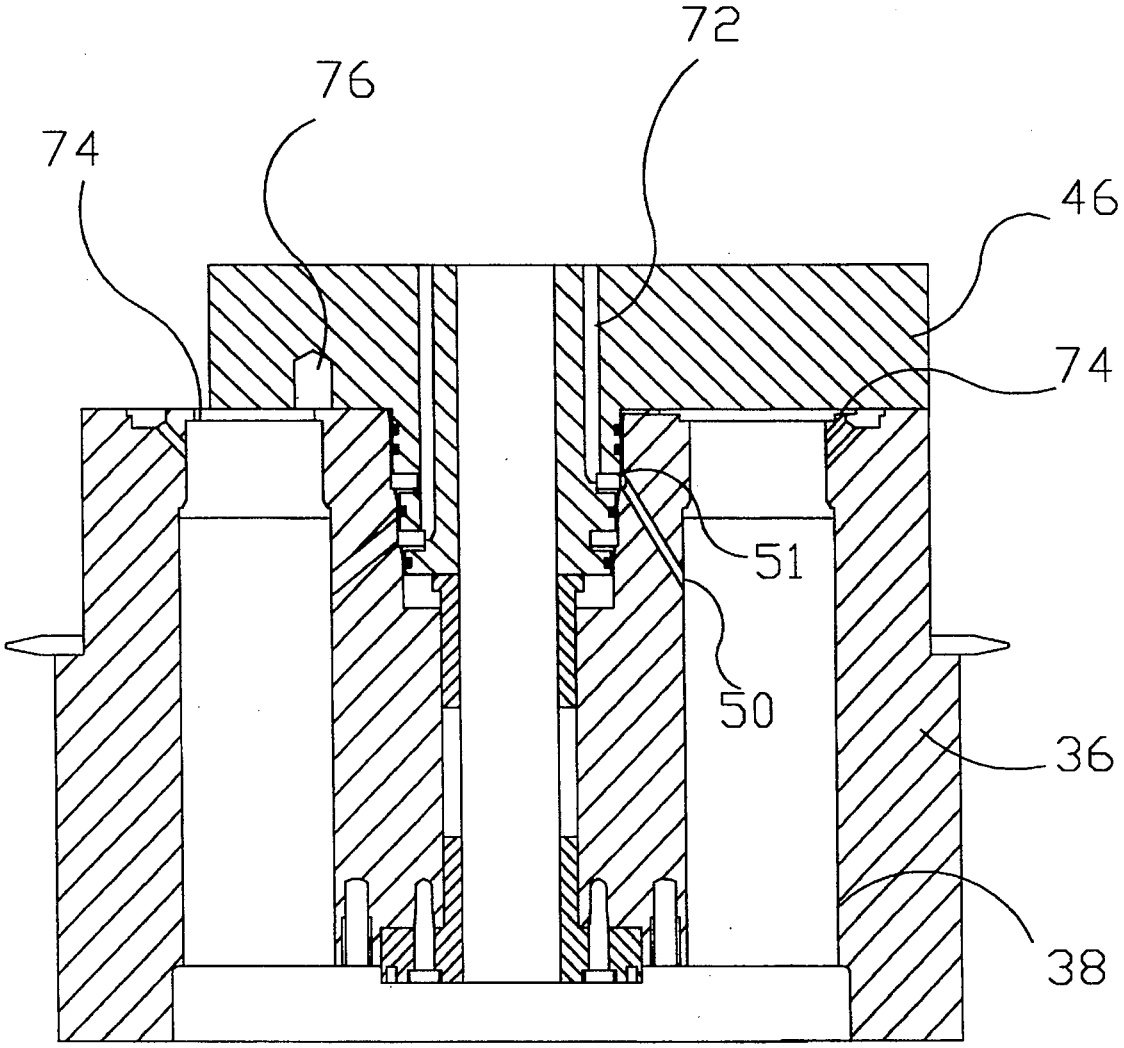
FIG. 4 is a cross sectional view of the carousel barrel 45° of the cross section of FIG. 1.

The carousel barrel 36 and the ports 38 are configured such that the cooling fluid for the target 40, preferably water, is introduced into the carousel barrel 36 and flows into a first port and circulates through the remaining ports before exiting the last or eighth port which is adjacent to the first port. The first port defines a channel 48 for the entrance of water into the port and the last port defines an outlet 50 for the outlet of water from the port, as shown in FIGS. 2, 3 and 4. Each of the remaining ports defines two openings 52, one in communication with the port in front of and one in communication with the port to the rear of the port. The first port defines an outlet opening 52 in communication with the opening 52 defined by the second port and the last port defines an inlet opening 52 in communication with the outlet opening 52 of the seventh port. In the preferred embodiment, the target 40 defines a threaded portion 54 on the exterior thereof to promote high velocity flow around the outside of the target 40, as shown in FIG. 2.

In the preferred embodiment, recirculated helium gas is utilized to cool the target window 32. Each port 38 defines a helium inlet 29 which is configured to be in communication with the helium supplier 24 of the ring collimator assembly 14 when that particular port 38 is aligned with the ring collimator assembly 14. An o-ring 31 is utilized to provide a seal between the helium supplier 24 and the helium inlet 29 of the port 38.

Figure 5:
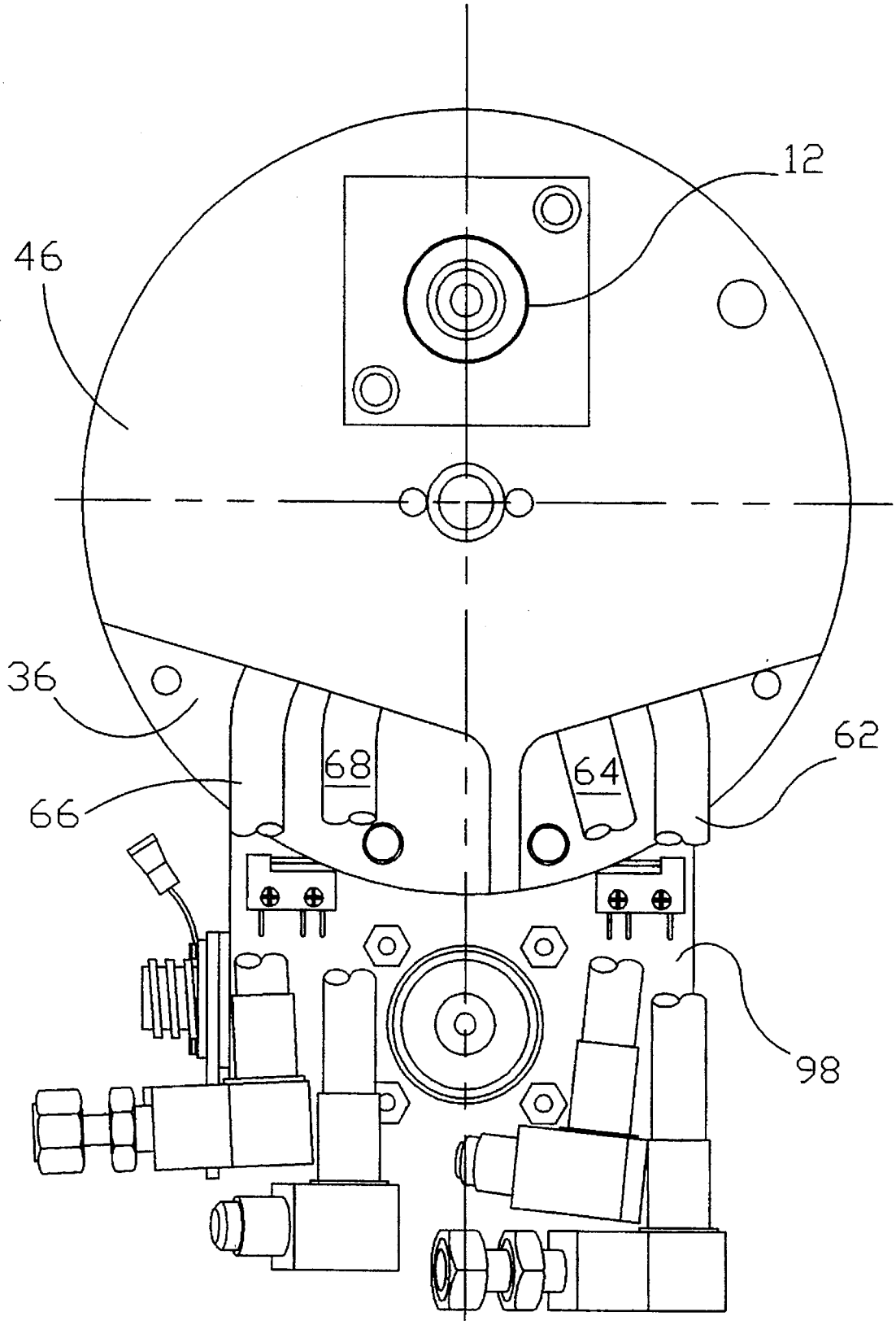
FIG. 5 is a view from the accelerator of the target changer of the present invention.

The carousel hub 46 is configured to distribute and collect water and helium and to permit rotation of the carousel barrel 36. Water and helium are distributed to and collected from the system via a water supply tube 68, a water outlet tube 64, a helium supply tube 62 and a helium outlet tube 66, as shown in FIG. 5. The water supply tube 68 is in communication with a water delivery channel 70 and the water outlet tube 64 is in communication with a water outlet channel 72. The delivery and outlet channels 70, 72 are defined by the carousel hub 46, as shown in FIGS. 2, 3 and 4. The delivery channel 70 is in communication with a gland 49 which is in turn in communication with the water inlet 48 defined by the first port. The water outlet channel 72 is in communication with a second gland 51 which is in turn in communication with the water outlet 50 of the last port. Of course, it will be noted that the flow around the barrel 36 can be reversed simply by switching the water supply and outlet tubes.

Helium is introduced via the helium supply tube 62. The supply tube 62 is in communication with the annular space 27 defined between the carousel hub 46 and the ring collimator assembly 14. Helium cools the vacuum window 22 and the target window 32, as described above. The helium flows into the disc shaped space 74 between the barrel 36 and the ring collimator assembly 14 and carousel hub 46. The helium exits through an exit port 76 defined by the carousel hub 46, shown in FIG. 3. The exit port 76 is in communication with the outlet tube 66 for the helium.

A plurality of o-rings 78 are utilized to insure proper seals where necessary to prevent leakage of helium and water, as depicted in FIG. 2.

The carousel hub 46 includes a hub tube 80, preferably fabricated from stainless steel, imbedded therein. The carousel barrel 36 rotates with respect to this hub tube 80 via two bearings 82, 84. As shown in FIGS. 1 and 2, the lower bearing 84 is secured to the barrel 36. In the preferred embodiment, the hub tube 80 defines a passage therethrough for accommodating and protecting the product line(s) 44 of each umbilical 42. Each product line 44 exits the end of the hub tube 80 facing the accelerator and extends to a delivery point. It will be noted that although only one product line is shown in FIG. 2, each umbilical defines at least one product line. If eight targets are installed, at least eight product lines extend through the hub tube.

Figure 6:
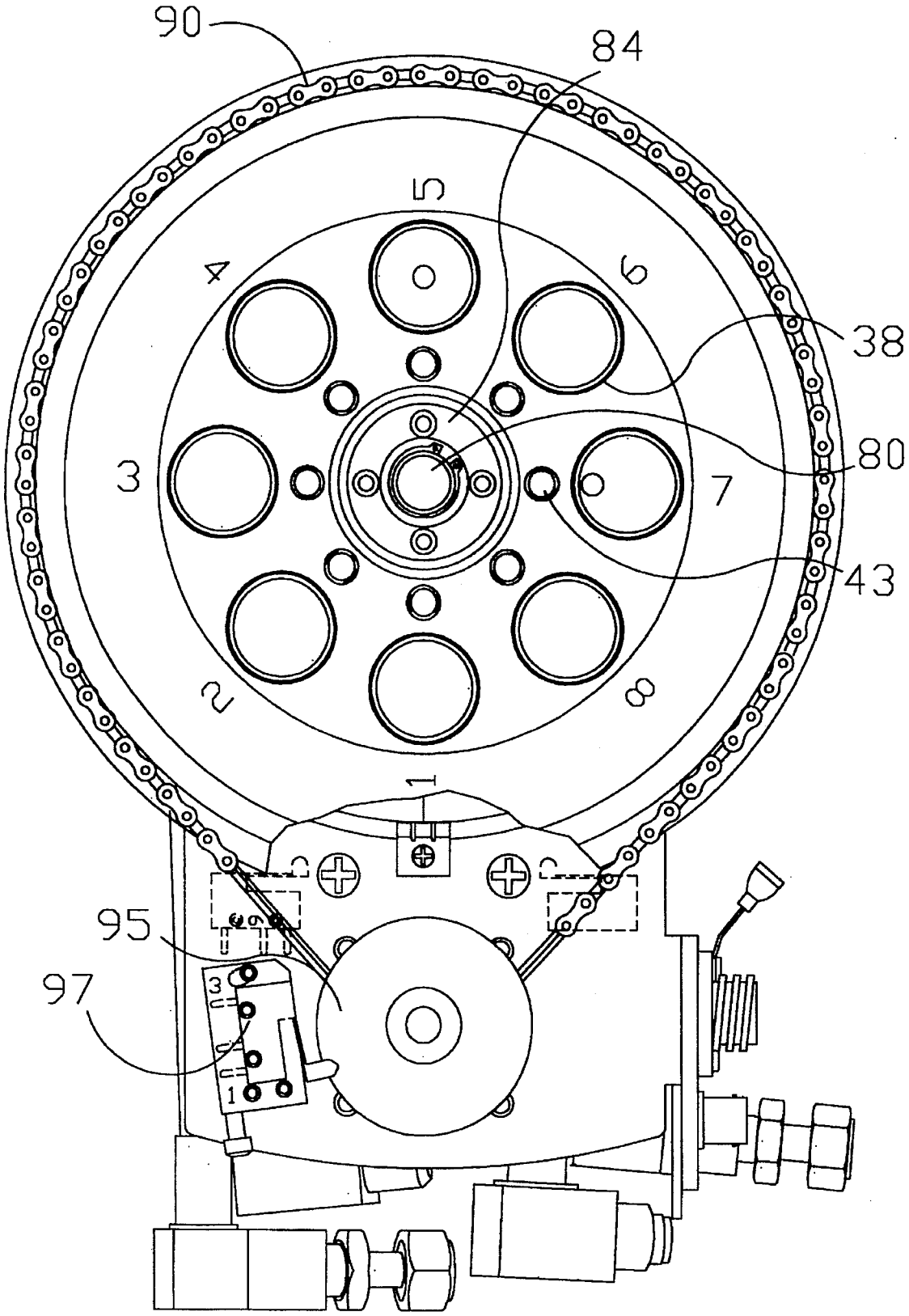
FIG. 6 is a view facing the accelerator of the target changer of the present invention.

The rotation of the carousel barrel 36 is controlled via a motor 86 and a chain and sprocket system 88, as shown in FIGS. 1 and 6. The motor 86 is mounted on a motor bracket 98 which is secured to the carousel hub 46 via two studs 100. The chain and sprocket system 88 is controlled by the motor 86 and includes a large sprocket 92 mounted on the exterior of the carousel barrel 36, a pinion 94, driven by the motor 86 and a chain 90 fitted to the pinion 94 and the large sprocket 92 of the carousel barrel 36. The alignment of any one port 38 with the ring collimator assembly 14 is provided by an 8:1 ratio between the pinnion 94 and the large sprocket 92. The ports 38 are set an equal 45° apart in the carousel barrel 36. Therefore, one full 360° revolution of the motor 86 corresponds to a rotation of the barrel 36 by 45°. Therefore, the notch in the cam 95 on the motor shaft is adjusted such that said notch is in line with a microswitch 97, when any one port 38 is aligned with the collimator 14. The microswitch 97 engages the notch on the cam 95 at every full revolution of the motor 86, and therefore every time a port 38 is aligned with the collimator assembly 14. The alignment of a particular target 40 can be done remotely, outside the shield.

The main concern with the rotation of the carousel barrel 36 is that the product lines 44 within the hub tube 80 are not twisted to the point that they rip. To prevent injury to the product lines 44, the rotation of the carousel barrel 36 is limited to 315° of motion. The limited degree of motion is accomplished by securing an "L" bracket 96 to the exterior of the carousel barrel 36. The "L" bracket 96 is configured to stop at the motor bracket mounting stud 100, preventing the carousel barrel 36 from rotating beyond that point and stalling the motor 86. With the limited degree of rotation, the product lines 44 become twisted but not to the extent that they are damaged.

To avoid the need to adjust the target position, an alignment fixture is used during installation of the target changer on to the accelerator to establish beam position coming out of the machine. Once the position is determined, the iron surface where the target changer is to be mounted is drilled at specific points and to specific depths. Then the target changer can be mounted on pins of uniform dimension. The adjustment is not lost if the target changer is removed, or even if a different target changer is installed in the same position. Operation of the alignment fixture can be done remotely (outside the shield) and dynamically (while beam is running).

To use the target changer 10, the targets 40 are inserted into respective ports 38 and respective umbilicals 42 are secured in the carousel barrel 36 to establish the high pressure seals. The target 40 to be bombarded is aligned with the ring collimator assembly 14 by rotating the barrel 36 via the motor 86 to the selected position. Circulation of the water and the helium is established. The selected target materials 41 are inserted in the targets 40 via the product lines(s) 44 and product tube(s) 35. Bombardment of the target is performed, and the product leaves the target 40 via the product tube(s) 35, moves into the product lines 44 and is subsequently delivered away from the device 10.

From the foregoing description, it will be recognized by those skilled in the art that a target changer offering advantages over the prior art has been provided. Specifically, the target changer provides a modular feature which minimizes the number of connections necessary for installing the targets. Further, the target changer is configured to minimize the time necessary to install or remove a target. Additionally, there is no impact on vacuum integrity when changing targets. Moreover, a change from one installed target to another can be done remotely (outside of the shield). Initial alignment of the target changer is performed by an alignment fixture, which can be operated remotely (outside of the shield) and dynamically (while the beam is running).

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A target changer for use with an accelerator for the remote changing of targets on accelerator beamlines, said target changer comprising:

a beam tube for guiding the accelerator beamline;

a ring collimator assembly defining a beam shaper and a vacuum window assembly, a first end of said beam tube being secured to a first end of said ring collimator assembly, said beam shaper for receiving and shaping the accelerator beamline, said vacuum window assembly being aligned with said beam shaper and for receiving the beamline therethrough;

a carousel hub defining a hub tube, said carousel hub retaining a portion of said ring collimator assembly;

a carousel barrel defining a plurality of ports, each of said plurality of ports for receiving a target, said carousel barrel being rotatable about said hub tube such that each of said plurality of ports is alignable with the beamline exiting said vacuum window assembly; and, a rotation mechanism for controlling the rotation of said carousel barrel.

2. The target changer of claim 1 wherein said target includes a target window, a target window spacer flange, a target body, and one or more product tube(s), said target body retaining a target material, said target window spacer flange for providing a space between said target window and a top of said target, said target window spacer flange defining at least one fluid jet for injecting fluid toward said target window to cool said target window, said product tube extending a length of said target body and for receiving a product resulting from bombarding said target material.

3. The target changer of claim 2 wherein said target is retained within said port with an umbilical, said umbilical defining one or more product line(s) and being configured to receive a captured socket head screw, said product lines(s) being matable with said product tube(s) for receiving the product within said product tube(s), an end of said captured socket head screw being secured in said carousel barrel proximate said port within which said target is retained thereby securely holding said umbilical against a bottom of said target and creating a high pressure seal between said target window and said target window spacer flange and creating a high pressure seal between said target window and said target body, and creating a high pressure seal between said product tube(s) or said target body and said product line(s).

4. The target changer of claim 3 wherein said hub tube defines a passage therethrough for accommodating and protecting said product line(s).

5. The target changer of claim 1 wherein said rotation mechanism includes a motor and a chain and sprocket mechanism, said motor being mounted to a motor bracket, said motor bracket being secured to said carousel hub, said chain and sprocket mechanism including a large sprocket, a pinion and a chain, said large sprocket being secured in a spaced manner to the exterior of said carousel barrel, said pinion secured to shaft of said motor and a rotation of said pinion being controlled by said motor, said chain being secured around said pinion and said carousel barrel via said large sprocket.

6. A target changer for use with an accelerator for the remote changing of targets on accelerator beamlines, said target changer comprising:

a beam tube for guiding the accelerator beamline;

a ring collimator assembly defining a beam shaper and a vacuum window assembly, a first end of said beam tube being secured to a first end of said ring collimator assembly, said beam shaper for receiving and shaping the accelerator beamline, said vacuum window assembly being aligned with said beam shaper and for receiving the beamline therethrough;

a carousel hub defining a hub tube, said carousel hub retaining a portion of said ring collimator assembly;

a carousel barrel defining a plurality of ports, each of said plurality of ports for receiving a target, said target including a target window, a target window spacer flange, a target body, and one or more product tube(s), said target body retaining a target material, said target window spacer flange for providing a space between said target window and end of said target, said product tube(s) extending a length of said target body and for receiving a product resulting from bombarding said target material, said target being retained within said port with an umbilical, said umbilical defining one or more product line(s) and being configured to receive a captured socket head screw, said product line(s) being matable with said product tube(s) for receiving the product within said product tube(s), an end of said captured socket head screw being secured in said carousel barrel proximate said port within which said target is retained thereby securely holding said umbilical against a bottom of said target and creating a high pressure seal between said target window and said target window spacer flange and creating a high pressure seal between said target window and said target body, and creating a high pressure seal between said product tube(s) or said target body and said product line(s), said carousel barrel being rotatable about said hub tube such that each of said plurality of ports is alignable with the beamline exiting said vacuum window assembly; and, a rotation mechanism for controlling the rotation of said carousel barrel.

7. The target changer of claim 6 wherein said hub tube defines a passage therethrough for accommodating and protecting said receiving tube.

8. The target changer of claim 6 wherein said rotation mechanism includes a motor and a chain and sprocket mechanism, said motor being mounted to a motor bracket, said motor bracket being secured to said carousel hub, said chain and sprocket mechanism including a large sprocket, a pinion and a chain, said large sprocket being secured in a spaced manner to the exterior of said carousel barrel, said pinion secured to the shaft of said motor and a rotation of said pinion being controlled by said motor, said chain being secured around said pinion and said carousel barrel via said large sprocket.

9. The target changer of claim 6 wherein said rotation of said carousel barrel is limited to less than 315°, said carousel barrel being rotatable in clockwise and counterclockwise directions.

10. The target changer of claim 6 wherein said target window spacer flange defines at least one fluid jet for injecting fluid toward said target window to cool said target window.

11. A target changer for use with an accelerator for the remote changing of targets on accelerator beamlines, said target changer comprising:

a beam tube for guiding the accelerator beamline;

a ring collimator assembly defining a beam shaper and a vacuum window assembly, a first end of said beam tube being secured to a first end of said ring collimator assembly, said beam shaper for receiving and shaping the accelerator beamline, said vacuum window assembly being aligned under said beam shaper and for receiving the beamline therethrough;

a carousel hub defining a hub tube, said carousel hub retaining a portion of said ring collimator assembly;

a carousel barrel defining a plurality of ports, each of said plurality of ports for receiving a target, said carousel barrel being rotatable about said hub tube such that each of said plurality of ports is alignable with the beamline exiting said vacuum window assembly; and, a rotation mechanism for controlling the rotation of said carousel barrel, said rotation of said carousel barrel being limited to less than 315°, said carousel barrel being rotatable in clockwise and counterclockwise directions.

* * * * *

UNITED STATES PATENT AND TRADEMARK OFFICE

CERTIFICATE OF CORRECTION

PATENT NO. : 5,608,224
DATED : March 4, 1997
INVENTOR(S) : Alvord C. William

It is certified that error appears in the above-identified patent and that said Letters Patent is hereby corrected as shown below:

Title page,
Item [73], please indicate the Assignee as:
-- CTI PET Systems, Inc., Knoxville, Tenn. --

Signed and Sealed this

Twenty-ninth Day of April, 2003

JAMES E. ROGAN
*Director of the United States Patent and Trademark Office*